US007591511B2

(12) United States Patent
Smith et al.

(10) Patent No.: US 7,591,511 B2
(45) Date of Patent: Sep. 22, 2009

(54) TAMPER RESISTANT ATTACHMENT DEVICE FOR A CHAIR BACKREST

(75) Inventors: Richard D. Smith, Springville, UT (US); David J. Laws, Provo, UT (US)

(73) Assignee: Mity-Lite, Inc., Orem, UT (US)

( * ) Notice: Subject to any disclaimer, the term of this patent is extended or adjusted under 35 U.S.C. 154(b) by 493 days.

(21) Appl. No.: 11/412,002

(22) Filed: Apr. 25, 2006

(65) Prior Publication Data

US 2007/0132302 A1 Jun. 14, 2007

Related U.S. Application Data

(60) Provisional application No. 60/749,778, filed on Dec. 12, 2005.

(51) Int. Cl.
*A47C 5/12* (2006.01)

(52) U.S. Cl. ..... 297/451.11; 297/445.1

(58) Field of Classification Search ..... 403/280, 403/315; 24/595.1; 297/451.11, 445.1, 452.1, 297/463.2, 440.2, 440.21
See application file for complete search history.

(56) References Cited

U.S. PATENT DOCUMENTS

| | | | | |
|---|---|---|---|---|
| 3,906,592 | A | 9/1975 | Sakasegawa et al. | |
| 4,291,855 | A | 9/1981 | Schenkel et al. | |
| 4,318,570 | A | 3/1982 | Adam et al. | |
| 4,359,809 | A | 11/1982 | Fraser | |
| 4,382,453 | A | 5/1983 | Bujan et al. | |
| 4,541,150 | A | 9/1985 | Brokmann | |
| 4,564,163 | A | 1/1986 | Barnett | |
| 4,624,432 | A | 11/1986 | Salacuse | |
| 4,881,705 | A | 11/1989 | Kraus | |
| 5,020,749 | A | 6/1991 | Kraus | |
| 5,113,717 | A | 5/1992 | Plamper | |
| 5,123,702 | A | 6/1992 | Caruso | |
| 5,146,656 | A | 9/1992 | Huang | |
| 5,211,446 | A * | 5/1993 | Jay et al. | 297/440.2 |
| 5,234,185 | A | 8/1993 | Hoffman et al. | |
| 5,277,387 | A | 1/1994 | Lewis et al. | |
| 5,497,537 | A | 3/1996 | Robinson et al. | |
| 5,826,312 | A | 10/1998 | Schroder et al. | |
| 5,961,184 | A | 10/1999 | Balderi et al. | |
| 6,003,948 | A | 12/1999 | Holbrook | |
| 6,070,940 | A | 6/2000 | Wu | |
| 6,116,692 | A | 9/2000 | Tarnay et al. | |
| 6,536,079 | B2 | 3/2003 | Hill | |
| 6,899,053 | B2 | 5/2005 | Hawkins | |
| 2004/0076465 | A1 | 4/2004 | Geiger | |
| 2004/0245842 | A1 | 12/2004 | Nardi | |

* cited by examiner

*Primary Examiner*—Milton Nelson, Jr.
(74) *Attorney, Agent, or Firm*—Thorpe North & Western, LLP

(57) ABSTRACT

A tamper resistant attachment apparatus for attaching a backrest to a chair frame. A flap is foldably coupled to an edge of a chair backrest. The flap is foldable over onto the backrest into a folded position. The flap has a channel that fits around a frame of a chair when the flap is in the folded position. At least one aperture that extends through the flap can receive a corresponding pin that is coupled to the backrest when the flap is in the folded position. The at least one pin is deformable to secure the flap and backrest around the chair frame when the flap is in the folded position.

16 Claims, 5 Drawing Sheets

TAMPER RESISTANT ATTACHMENT DEVICE FOR A CHAIR BACKREST

Benefit is claimed of U.S. Provisional Patent Application No. 60/749,778, filed Dec. 12, 2005, which is herein incorporated by reference in its entirety for all purposes.

BACKGROUND OF THE INVENTION

1. Field of the Invention

The present invention relates generally to chairs, and more particularly to affixing a backrest and seat to a chair frame.

2. Related Art

Typical chairs have a backrest and seat that are attached to a chair frame. Some backrests and seats are attached to the chair frame by stapling a cloth or fabric to a wood frame. Others are attached by riveting or screwing a backrest or seat frame to the chair frame. Most backrests or seats require some sort of fastener, such as rivets, screws, bolts, staples, or the like to attach the backrest or seat to the chair frame. However, these fasteners are problematic in that they increase the production time and cost for chairs. Moreover, use of separate fasteners to attach a backrest of seat to a chair frame can result in lost fasteners, both during the production of the chair and in after-production use since traditional fasteners can commonly work themselves loose. Additionally, many traditional types of fasteners are easily tampered with such that the fastener can be removed thereby loosening or removing the backrest or seat.

SUMMARY OF THE INVENTION

It has been recognized that it would be advantageous to develop a device and method for attaching a chair backrest and seat to a frame that uses a self fastening mechanism to eliminate separate fasteners. Additionally, it has been recognized that it would be advantageous to develop a device and method for attaching a chair backrest and seat to a frame that is not easily tampered with and reduces the possibility of a loose or missing backrest or seat.

The invention provides for a tamper resistant attachment apparatus for attaching a backrest to a chair frame. The apparatus can include a backrest supportable by a chair frame. A flap can be foldably coupled to an edge of the backrest. The flap can be foldable around the chair frame and onto the backrest in a folded position. A channel extends along the flap, and can be sized and shaped to fit around the chair frame when the flap is in the folded position. The flap has at least one aperture and receives a corresponding pin that is coupled to the backrest. The pin can be deformable and can secure the flap against the backrest with the chair frame enclosed in the channel when the flap is in the folded position and the pin is deformed.

In another aspect, the present invention provides for a chair with a tamper resistant backrest and seat attachment apparatus including a backrest that can be sized and shaped to fit in a back frame of the frame of the chair. A plurality of flaps can be pivotally or foldably coupled to a portion of a peripheral edge of the backrest. A plurality of pins can be coupled to the backrest or seat and can correspond in position to at least one aperture in each flap when the flaps are in a folded or closed position. Each pin can be deformable to secure the flap and backrest around the chair frame when the flap is in the closed position.

The present invention also provides for a method for attaching a backrest to a chair frame including placing a backrest on the chair frame. The backrest can have a plurality of foldable flaps that can be folded to enclose the chair frame in a channel formed in the flap, and an aperture on each of the plurality of flaps can fit over a corresponding pin that can protrude from the backrest. Each of the plurality of pins can be deformed to form a pin head that secures the flap around the chair frame and against the backrest.

Additional features and advantages of the invention will be apparent from the detailed description which follows, taken in conjunction with the accompanying drawings, which together illustrate, by way of example, features of the invention.

DETAILED DESCRIPTION

Figure 1:
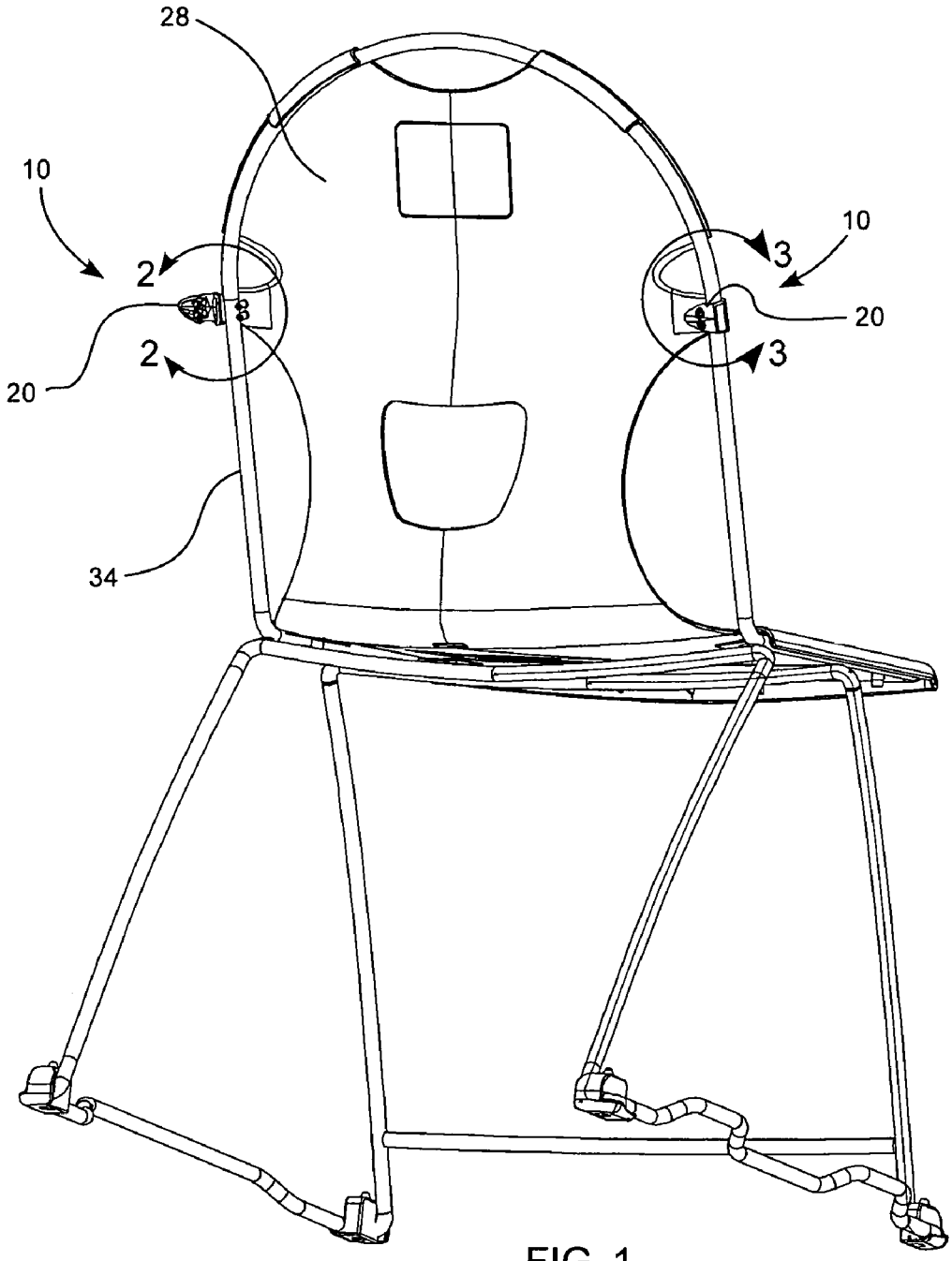
FIG. 1 is a rear perspective view of a tamper resistant, fastenerless attachment apparatus for a chair backrest or seat in accordance with an embodiment of the present invention, shown in relation to a chair.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

The present invention generally provides for an attachment apparatus to attach a backrest or seat to a chair frame. The attachment apparatus has a flap hinged to the backrest or seat. The flap can be folded over and onto the backrest or seat to a folded position. The flap has a channel that can enclose about the chair frame when the flap is in the folded position. The flap also has at least one hole or aperture. The hole fits over a pin that is coupled to the backrest or seat. The flap and the pin can be integrally formed with the backrest. When the flap is in the folded, the pin can protrude through the flap. The protruding portion of the pin can be deformed to secure the flap in the closed position, thereby retaining the chair frame in the channel.

In addition, the present invention provides a method for attaching a chair backrest or seat to a chair frame including positioning a backrest in a chair frame and folding a flap coupled to the backrest or seat over the frame. The flap can be secured to the backrest or seat with a pin coupled to the backrest.

As illustrated in FIGS. 1-4, an attachment apparatus, indicated generally at 10, in accordance with the present invention is shown for use in attaching a backrest or seat to a chair frame, such as a wire chair frame, a tubular chair frame, or the like. It will be appreciated that the attachment apparatus of the present invention can be used to attach either a backrest or a seat, or both, to a chair frame. Accordingly, for purposes of this application, the terms "backrest" and "seat" are interchangeable and for convenience will hereafter be referred to as only as "backrest" with the understanding that while the description below refers to a chair "backrest", the principles described could equally apply to a chair "seat".

Figure 2:
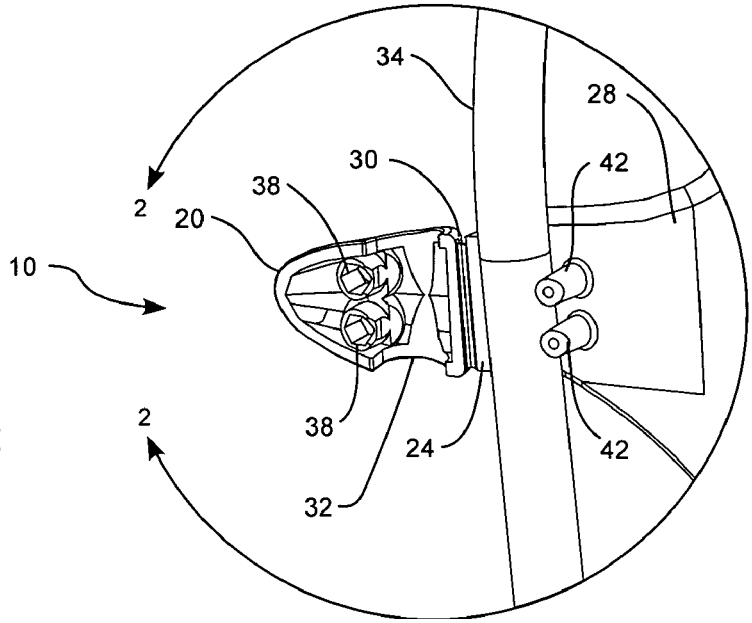
FIG. 2 is a perspective view of the attachment apparatus of FIG. 1, shown in an open configuration.
Figure 3:
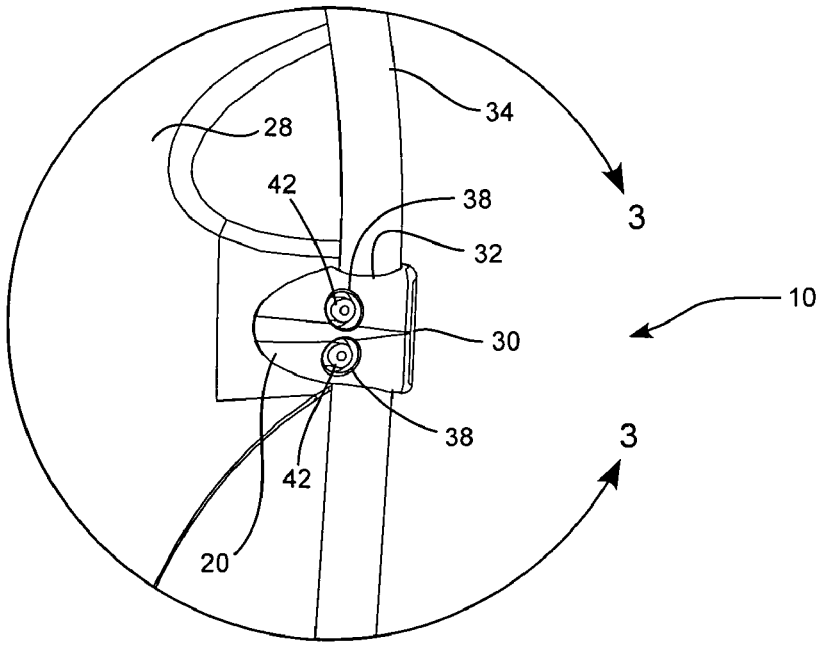
FIG. 3 is a perspective view of the attachment apparatus of FIG. 1, shown in a closed configuration.

The attachment apparatus 10 has a flap 20 that is pivotably or foldably coupled to an edge 24 of a chair backrest 28. The flap 20 can have an open position as shown in FIG. 2. The flap 20 can also have closed or folded position as shown in FIG. 3. In the folded position, the flap 20 can be pivoted or folded over and onto the backrest 28. The flap 20 and the backrest 28 can be formed from a moldable plastic material. In one aspect, the flap 20 and the backrest 28 can be made from the same moldable plastic material, and, thus, the flap 20 can be integrally formed with the backrest 28.

A bendable membrane 30 can couple or hinge the flap 20 to the backrest 28. The bendable membrane 30 can act as a hinge that allows the flap 20 to pivot or fold over onto the backrest 28. In the case where the flap 20 and backrest 28 are integrally formed, the bendable membrane 30 can also be integrally formed as a thinner region of the same moldable plastic material between the flap 20 and the backrest 28. In another aspect, the bendable membrane 30 can form a living hinge between the backrest 28 and the flap 20.

The flap 20 can also have a channel 32 that can extend along the flap 20. The channel 32 can be sized and shaped to fit around, and enclose about, a frame 34 of a chair when the flap 20 is in the folded position. In the case where the chair frame 34 is a wire frame or tubular frame, the channel 32 can have a substantially cylindrical shape that corresponds to the cylindrical shape of the chair frame 34. It will be appreciated that the shape of the channel 32 can correspond to other common chair frame shapes, as known in the art.

The flap 20 can also have at least one aperture 38. In one aspect, the aperture 38 can be a hole that extends through the flap 20. The aperture 38 can be formed in the flap 20 away from the channel 32 so that when the flap 20 is in the folded position, the chair frame 34 enclosed in the channel 32 will not interfere or close off the aperture 38.

The at least one aperture 38 can receive and fit over at least one pin 42 coupled to the back rest or seat 28. As shown in FIGS. 1-3, the flap 20 can have two apertures 38 and the backrest or seat 28 can have two pins 42 that correspond in position to the two apertures 38 when the flap 20 is in the folded position. The pins 42 can be sized and shaped to fit through the apertures 38.

A portion 46 of the pins 42 can protrude out of the apertures 38 when the flap 20 is in the closed position. The pins 42 can be deformable so that the portion 46 that protrudes out of the apertures 38 can be deformed into a head 50 with a larger size than the aperture 38. By creating a head 50 on the pins 42, the pins can secure the flap 20 from opening and lock or clamp the flap 20 and backrest 28 around the chair frame 34. The pins 42 can be deformed by applying heat to the pin 42. Thus, in one aspect, the pins 42 can be heat stakes that are driven through the flap 20 and deformed by heat to stake the flap 20 into place on the backrest 28.

The pins 42 can be formed of a moldable plastic and can be integrally formed with the backrest 28. In this way, the attachment apparatus 10 can have no loose or separate parts, such as fasteners, but instead is formed as a single piece integrally formed with the backrest 28. Advantageously, a single piece attachment apparatus decreases production time and costs since additional parts do not have to be added to the attachment apparatus. Additionally, the attachment apparatus of the present invention can reduce production costs over attachment devices that use fasteners because loose parts, such as fasteners, will not be lost or broken in the manufacturing process.

The at least one aperture 38 can have a polygonal shape or cross section, so that when the pin 42 is deformed to form the head 48, portions of the pin can deform to a corresponding polygonal shape. The polygonal shape of the aperture provides several advantages to locking the flap 20 of the present invention. For example, the portions of the pin that deform to the polygonal shape can restrict motion of the pin 42. It will be appreciated that, even slight motion of the pin could result in fatigue and ultimately in failure of the pin.

Additionally, the aperture 38 can be slightly smaller than the pin 42 creating an interference fit between the pin and the aperture. Advantageously, an interference fit strengthens the pin-aperture coupling. Furthermore, an aperture 38 with a polygonal shape is more easily deformable because of the flats of the polygon can bend in response to applied loads while the points of the polygon resist movement and act to substantially retain the basic cross sectional area of the polygon. Thus, when a slightly larger pin 42 is pressed through the aperture 38, the points of the polygonally shaped aperture 38 resist deformation of the flats such that the pin is allowed to pass through the aperture 38, but an interference fit is created between the pin 42 and the aperture 38.

Figure 4:
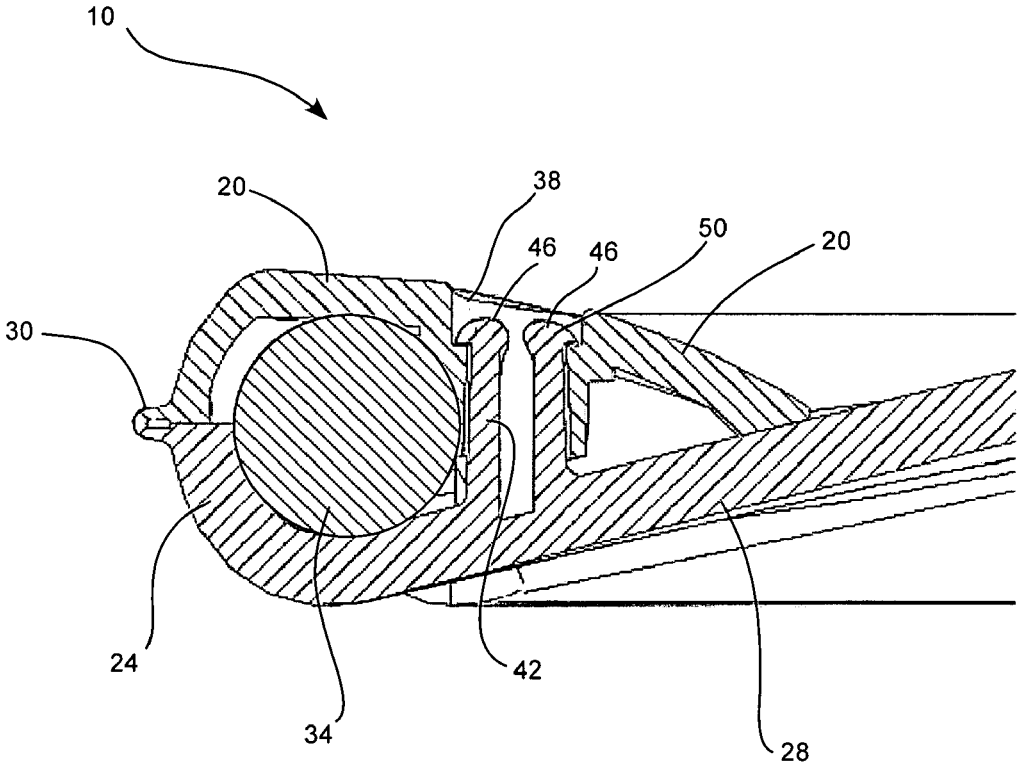
FIG. 4 is a cross section view of the attachment apparatus of FIG. 1, shown in a closed configuration.

As illustrated in FIG. 4, in use, the backrest 28 can be positioned in a chair frame 34 and the flap 20 on the backrest 28 can be folded over the chair frame 34 to enclose the chair frame 34 in the channel 32. The pins 42 on the backrest 28 can fit into the apertures 38 on the flap 20, and a portion 46 of the pins 42 can protrude out of the apertures 38. The pins 42 can be deformed to form a head 50 on the pin. The head 50 on the pin can secure the flap 20 from opening and releasing the chair frame 34. Consequently, the flap 20 can clamp around the chair frame 34 and secure the backrest 28 to the chair frame 34, and the pins 42 can lock the flap 20 to retain the flap 20 in the folded position.

Figure 5:
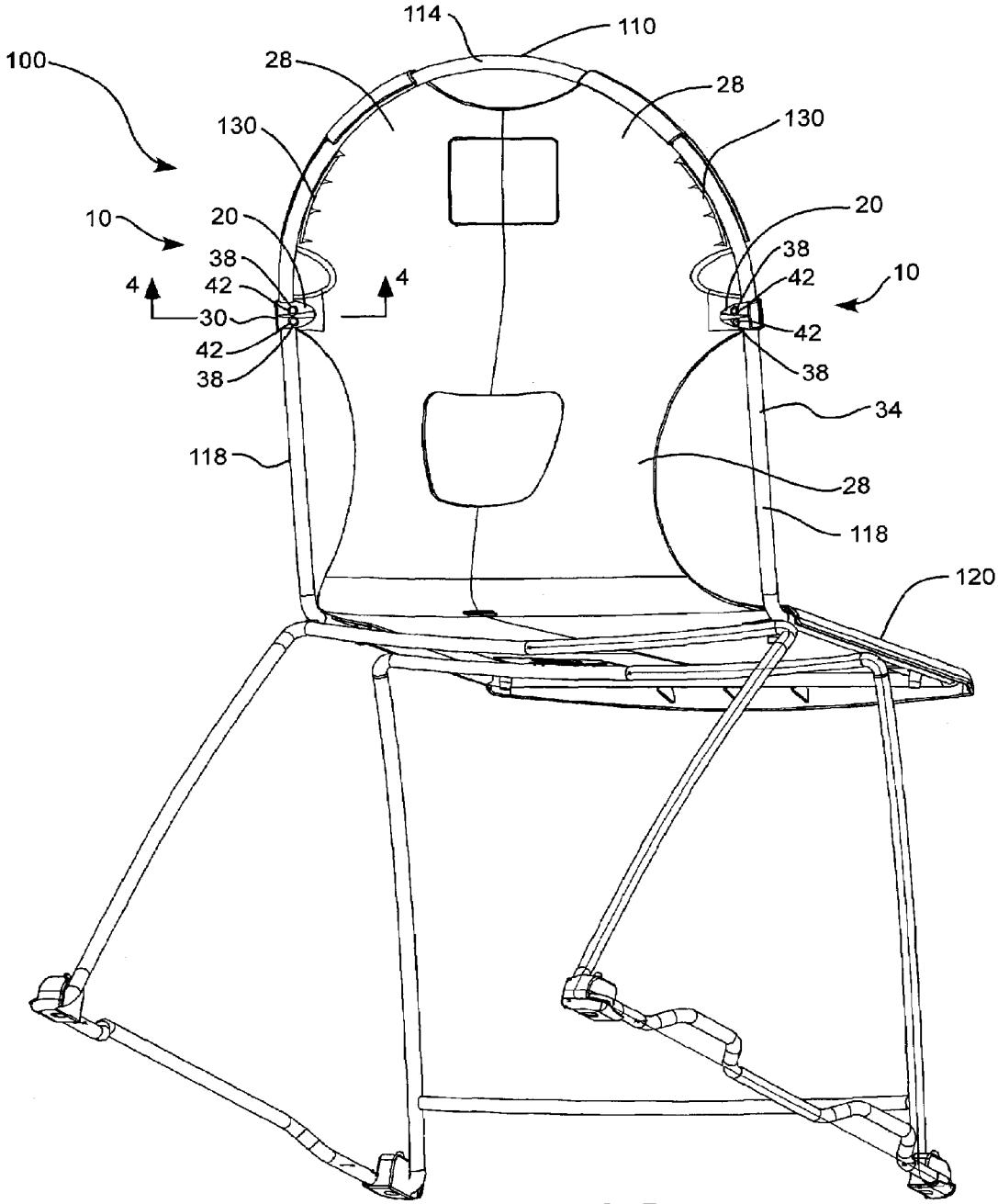
FIG. 5 is a perspective view of a chair having a plurality of tamper resistant, fastenerless backrest or seat attachment devices in accordance with an embodiment of the present invention.

Referring to FIG. 5, a chair, shown generally at 100, is shown with a backrest 28 attached to a chair frame 34 with the tamper resistant attachment apparatus 10 described above in accordance with an embodiment of the present invention. The chair frame 34 includes a back frame 110 and a seat frame 120. The chair also includes a backrest 28 that can be sized and shaped to fit in and be supported by the back frame 110.

The backrest 28 can have a plurality of flaps 20 that are pivotally or foldably coupled to a peripheral edge 24 of the backrest 28. Each flap 20 can be coupled to the backrest 28 by a bendable membrane 30 in order to allow each flap 20 to pivot or fold onto the backrest or seat 28 into a folded position.

As described above, each flap 20 can have a channel 32 that can extend along the flap 20. The channel 32 can be sized and shaped to fit around the back frame 110 of the chair 100 when the flap 20 is in the folded position. The flap 20 can also have at least one aperture 38 formed in the flap 20. The aperture 38 can be formed away from the channel 32 to prevent interference of the aperture 38 by the back frame 110.

A plurality of pins 42 can be coupled to the backrest or seat 28. Each pin 42 from the plurality of pins 42 can correspond in position to the at least one aperture 38 of each flap 20 when the flaps 20 are in the closed position. Each of the plurality of pins 42 can be sized and shaped to fit in the apertures 38. Additionally, each pin 42 can be deformable to secure the flap 20 around the back frame 110 with the back frame 110 enclosed in the channel 32 when the flap 20 is in the folded position.

The back frame 110 can also have an upper curvilinear member 114 that can extend between two lateral posts 118. The lateral posts 118 can extend downward from the curvilinear member 114 to the seat frame 120.

A frame guide 130 can be formed in the backrest 28 and can be sized and shaped to fit around the back frame 110. The frame guide 130 can position the backrest 28 on the back frame 110 and secure the backrest 28 from movement on the lateral posts 118 when the flaps 20 are locked in the folded position. Thus, the backrest 28 can be secured to the chair frame 34 by the flaps 20 and be restricted from movement along the chair frame 34 by the frame guides 130.

Figure 6:
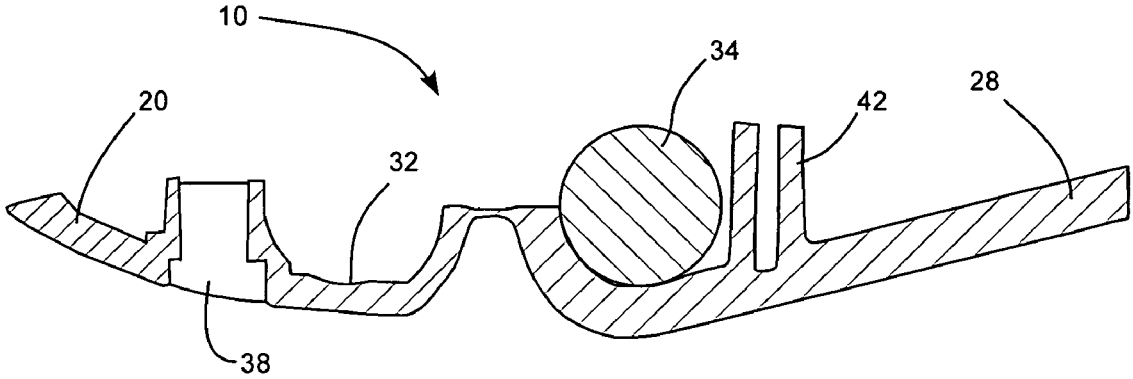
FIG. 6-8 illustrate a method for fastening a backrest or seat to a chair frame.
Figure 7:
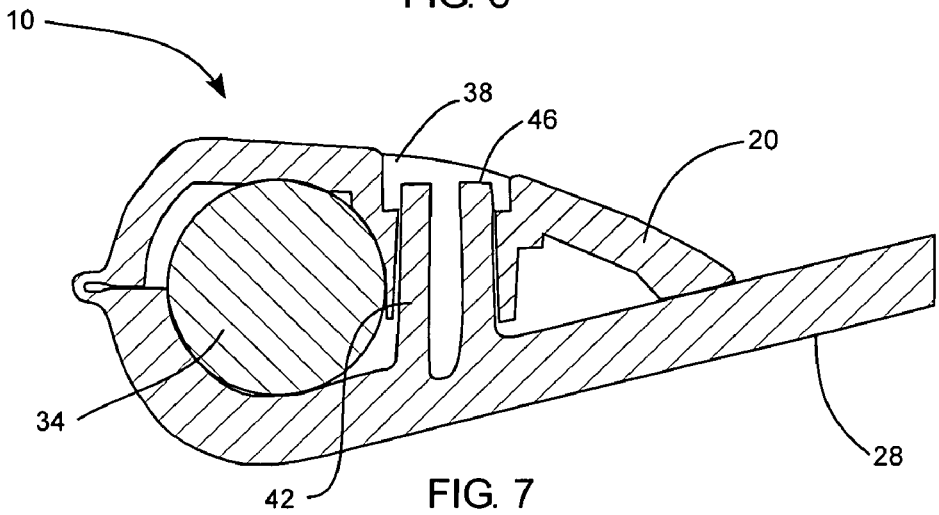
Figure 8:
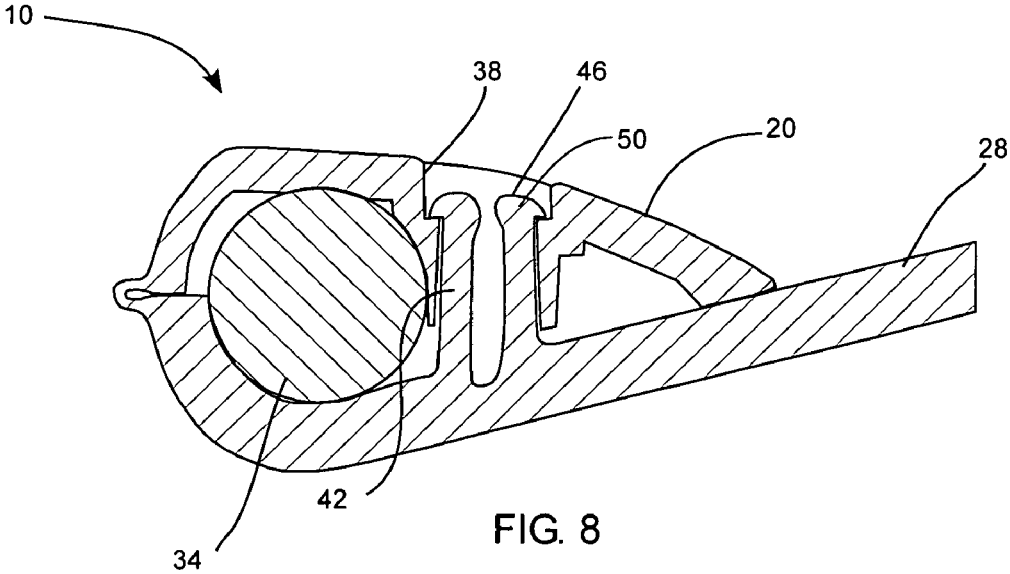

As illustrated in FIGS. 6-8, the present invention also provides for a method for attaching a backrest 28 to a chair frame 34 including placing a backrest on the chair frame, as shown in FIG. 6. The backrest can have a plurality of flaps 20. Each of the plurality of flaps can be folded to enclose the chair frame in a channel 32 formed in the flap, and an aperture 38 on each of the plurality of flaps can fit over a corresponding pin 42 that can protrude from the backrest, as shown in FIG. 7. A portion 46 of each of the plurality of pins can be deformed to form a pin head 50 that secures the flap around the chair frame and against the backrest, as shown in FIG. 8. Each of the plurality of pins can be deformed by heating the pins and applying a force to form a head on the pin. It will be appreciated the head on the pin can also be formed by mechanical force alone, as known in the art.

It will also be appreciated that while the embodiments described herein have a pin protruding from a backrest that fits into an aperture on a flap, the positions of the pin and aperture can be switched. Namely, the pin can be formed on, and extend away from the flap, and the aperture can be formed in the backrest. Thus, the pin on the flap can extend into the aperture on the backrest when the flap is folded over the chair frame.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. A tamper-resistant, fastenerless attachment apparatus for attaching a backrest to a chair frame, comprising:

a) a backrest, supportable by a chair frame;

b) a flap, foldably coupled to an edge of the backrest, and foldable around the chair frame and onto the backrest in a folded position;

c) a channel, extending along the flap, and sized and shaped to fit around the chair frame when the flap is in the folded position;

d) at least one aperture, formed in the flap;

e) at least one pin, coupled to the backrest, and corresponding in position to the at least one aperture when the flap is in the folded position; and f) the pin being deformable to secure the flap against the backrest with the chair frame enclosed in the channel when the flap is in the folded position.

2. An apparatus in accordance with claim 1, further comprising:

a hinge, coupling the flap to the backrest, wherein the hinge allows the flap to pivot or fold over onto the backrest or a seat.

3. An apparatus in accordance with claim 2, wherein the flap, the hinge, and the at least one pin are integrally formed with the backrest.

4. An apparatus in accordance with claim 1, wherein the at least one aperture and the at least one pin includes two apertures and two corresponding pins.

5. An apparatus in accordance with claim 1, wherein the channel forms a substantially cylindrical channel that is sized and shaped to fit a substantially cylindrical chair frame when the flap is in the folded position.

6. An apparatus in accordance with claim 1, wherein the at least one aperture has a polygonal cross section.

7. An apparatus in accordance with claim 6, wherein the at least one pin has a polygonal shape corresponding to the polygonal cross section of the at least one aperture.

8. An apparatus in accordance with claim 1, wherein the at least one pin is formed from a thermoplastic material that is deformable by heat.

9. An apparatus in accordance with claim 1, wherein the flap and backrest form a clamp around the chair frame when in the folded position to secure the backrest to the chair frame.

10. A chair with a tamper-resistant, fastenerless backrest and seat attachment apparatus, comprising:

a) a chair frame, including a back frame;

b) a backrest, supported by the back frame;

c) a plurality of flaps, foldably coupled to a peripheral edge of the backrest, each flap being folded around the back frame and onto the backrest in a folded position, and each flap comprising:

i) a channel, extending along the flap, sized and shaped to fit around the back frame when the flap is in the folded position; and ii) at least one aperture, formed in the flap;

d) a plurality of pins, coupled to the backrest, and each pin corresponding in position to the at least one aperture of each flap when the flap is in the folded position; and e) each pin being deformed to secure the flap against the backrest with the back frame enclosed in the channel when the flap is in the folded position.

11. A chair in accordance with claim 10, further comprising:

a plurality of hinges, each hinge coupling one of the plurality of flaps to the backrest, wherein the hinge allows the flap to pivot or fold over onto the backrest or a seat.

12. A chair in accordance with claim 11, wherein the plurality of flaps, the plurality of hinges, and the plurality of pins are integrally formed with the backrest.

13. A chair in accordance with claim 11, wherein the backrest, the plurality of flaps, the plurality of hinges, and the plurality of pins are formed together in a mold.

14. A chair in accordance with claim 10, wherein the back frame further includes an upper most curvilinear member extending between two lateral posts and the lateral posts extend from the curvilinear member to a seat frame.

15. A chair in accordance with claim 14, wherein the backrest further includes at least one frame guide sized and shaped to fit around the back frame and configured to secure the backrest in position on the back frame.

16. An apparatus in accordance with claim 10, wherein the flap and backrest form a clamp around the back frame when in the folded position and the deformed pin secures the clamp to the back frame.

* * * * *